United States Patent [19]

Mance et al.

[11] Patent Number: 4,763,370

[45] Date of Patent: Aug. 16, 1988

[54] APPARATUS AND METHOD FOR DYEING SHEET ARTICLES

[76] Inventors: Darko Mance, 208 Voltaira Crescent, Mississauga, Ontario, Canada, L5A 2A4; Vitomir Mance, 279 Main St. North, Rockwood, Ontario, Canada, N0B 2K0

[21] Appl. No.: 868,502

[22] Filed: May 30, 1986

[51] Int. Cl.[4] ..... D06P 7/00; D06B 1/14

[52] U.S. Cl. ..... 8/150.5; 8/151; 68/202; 69/32; 118/212; 118/245; 118/249

[58] Field of Search ..... 68/202, 203, 128, 264, 68/270, 22 B; 69/32; 101/153, 157, 170; 118/212, 245, 246, 249; 100/174; 8/151, 150.5

[56] References Cited

U.S. PATENT DOCUMENTS

| | | | |
|---|---|---|---|
| 530,831 | 12/1894 | Florin-Leclercq | 68/202 X |
| 813,708 | 2/1906 | Jagenberg | 118/249 X |
| 1,237,374 | 8/1917 | Oberley | 100/174 |
| 2,164,270 | 6/1939 | George | 101/153 |
| 2,279,553 | 4/1942 | Bradt | 68/202 X |
| 2,429,314 | 10/1947 | Goldman | 118/246 |
| 2,912,960 | 11/1959 | Black et al. | 118/245 X |
| 2,971,458 | 2/1961 | Kumins et al. | 68/202 X |
| 3,036,927 | 5/1962 | Jerothe | 118/212 X |
| 3,393,661 | 7/1968 | Sharp | 118/411 |
| 3,530,692 | 9/1970 | Schweizer et al. | 68/202 |
| 3,647,525 | 3/1972 | Dahlgren | 68/202 X |
| 3,650,242 | 3/1972 | Mahoney | 118/246 |
| 3,817,748 | 6/1974 | Whittaker | 101/170 X |
| 4,099,393 | 7/1978 | Norris et al. | 68/202 X |
| 4,244,200 | 1/1981 | Sando et al. | 68/202 |
| 4,349,930 | 9/1982 | Van Wersch et al. | 8/151 |
| 4,372,001 | 2/1983 | Maier | 8/151 |

FOREIGN PATENT DOCUMENTS

| | | | |
|---|---|---|---|
| 242120 | 9/1969 | U.S.S.R. | 68/202 |

*Primary Examiner*—Philip R. Coe

*Attorney, Agent, or Firm*—Rogers, Bereskin & Parr

[57] ABSTRACT

An apparatus for dyeing leather has an application roller and a backup device defining a gap therebetween. The application roller has recesses, and dye is supplied to it to fill the recesses. Sheet articles, e.g. leather pieces, are fed through the gap. The apparatus is operated so that a uniform coating of dye is continuously spread over one surface of the article by the application roller. The dye can have a low viscosity comparable to that of water.

26 Claims, 5 Drawing Sheets

APPARATUS AND METHOD FOR DYEING SHEET ARTICLES

FIELD OF THE INVENTION

This invention relates to an apparatus and method for dyeing sheet articles. This invention more particularly relates to a dyeing technique for leather, which does not require total immersion of the leather in a bath.

BACKGROUND OF THE INVENTION

Presently, leather is processed in a tannery, where raw hides are converted into leather in a series of chemical and physical operations. These processing operations can be divided into wet operations and dry operations. The wet operations include soaking, liming, deliming, bating and pickling. This is followed by tanning, re-tanning, fatliquoring and dyeing. Following the wet operations, the dry operations are carried out. These comprise finishing the leather, as by coating with film-forming materials.

Leather is conventionally dyed in drums by a so-called exhaust system. Hides or skins are loaded into the drum. Water is fed into the drum and the drum rotated, to cause the hides and water to tumble around inside the drum. Dyestuff is then added. The dyestuff is exhausted, as it is absorbed by the leather. For commercial scale production, the drums are quite large, and may hold 500–1,000 pounds of leather. Consequently, it can take a long time, for example 1–2 hours, for the dyestuff to be exhausted, the time being generally independent of the load.

This conventional technique has a number of disadvantages or problems. Firstly, it is common for the colour to be incorrect. This is only apparent once a complete batch has been processed and dried. Correcting colour errors is difficult. The process is only suitable for processing large batches, and cannot economically be applied to small batches.

Because of these difficulties, more recent proposals have relied upon techniques such as spraying, curtain coating, dip dyeing and roller coating. These techniques are used to dye crust leather.

Spraying is mostly used for colour correcting previously dyed leather. This is because it is difficult to apply large quantities of dye by spraying. If one attempts to apply large quantities, this generates a large quantity of mist and frequently causes the reverse side of the leather to be wetted by the dye as well. In many cases, this is undesirable. Also, the use of a heavy spray causes the conveyors on which the leather is placed to be contaminated, and results in considerable wastage of dye. This, and necessary ventiliation for most removal, can cause pollution problems. Curtain coating is a technique in which the dye is caused to fall as a continuous vertical film or curtain, that is applied to the leather. The intention is that the curtain of dye will apply a uniform curtain to the leather surface. However, in order to form a continuous curtain, it is necessary to add thickening agents to the dye solution. Such thickening agents have the disadvantage of reducing the dye penetration into the leather. In this respect, it is to be noted that relatively small increases in the viscosity of the dye solution can significantly affect the penetration into the leather.

One dip dyeing technique is known as the Multimac method, and the Multimac Dyeing Machine is built by Trockentechnik GmbH of West Germany. In this technique, individual pieces of leather are guided through a bath of dye, and then withdrawn through a pair of samming rolls. This technique has the disadvantage that the leather is dyed on both sides, and it is not possible to simply dye one side. Further, the leather absorbs 100% of moisture and has to be dried and reprocessed, similarly to leather from the drum of the exhaust system dyeing technique.

As regards to roller coating techniques, there are three principal roller arrangements. In the direct method, a gravure roll applies a coating directly to the leather. In a reverse process, a gravure roll again applies a coating directly to the leather, but the direction of rotation of the roll is reversed relative to the direction of movement of the leather. There is also an indirect method, in which the finish is first transferred from a gravure roll to a rubber appicator roll, which applies the finish to the leather.

These roller coating techniques are primarily intended for applying a coating to the surface of dyed leather, which coating can have a high viscosity, rather than applying a dye that is absorbed below the surface of the leather. In order for such roller coaters to work properly, the liquid used has to have a certain viscosity, if it is to be properly retained in the screen of the gravure roll. However, for proper absorption of dye, it needs to have a low viscosity, so that it is readily absorbed to a considerable depth in the leather. Deep absorption of the dye is necessary for good buff and scratch resistance. Further, because of the nature of the application rollers and the viscosities that have to be used, usually only relatively small quantities of material can be applied. Suggested techniques can apply significant quantities of a relatively high viscosity dye but this requires a reverse process. In this context, it should be kept in mind that relatively small differences in viscosity can have a significant effect on absorption.

In general, existing roller techniques cannot apply the required quantities of a low viscosity dye necessary to get deep penetration of the dye.

SUMMARY OF THE PRESENT INVENTION

Accordingly, it is desirable to dye leather by a technique which can give consistent results and which is applicable to small batches of leather. Further, the apparatus used should permit dyes of ordinary viscosity to be used, without the necessity of adding any thickening agents. The method should also desirably not waste any of the dye, or create any unnecessary contamination.

In accordance with the present invention, there is provided an apparatus for dyeing sheet articles, the apparatus comprising: an input means for supplying articles to the apparatus; a rotatably mounted application roller means including recess means in the surface thereof; dye supply means for supplying dye to the surface of the application roller; and a backup means mounted against the application roller, the application roller and backup means being arranged to receive, in use, sheet articles therebetween from the input means, with the recess means of the application roller means carrying dye onto one side of the sheet articles, the apparatus not including a doctor blade means to remove excess dye from the application roller means.

In accordance with another aspect of the present invention, there is provided a method of dyeing sheet articles utilizing the apparatus as just defined, the method comprising supplying dye to the application roller means, rotating the application roller means, and supplying a sheet article between the application roller means and a backup means, so that dye from the application roller means is applied to the sheet article, without removing excess dye from the application roller means by a doctor blade.

It is expected that the apparatus and method of the present invention will be particularly suited to the dyeing of leather.

Leather presents particular problems due to the fact that it comes in various sizes, shapes and thicknesses, unlike continuous web materials, such as fabrics, paper or plastic sheet.

The apparatus and method of the present invention should provide numerous advantages when applied to leather. It is expected that leather can be dyed with the dye being uniform and well penetrated, and this can be achieved in one passage through the apparatus.

The apparatus should enable the rate of application of the dye to be controlled as desired. This can be achieved by selection of a suitable roller, with appropriate size and spacing of recesses, selection of dye and selection of operating characteristics of the apparatus, such as speed.

The method is capable of simple operation, and can enable leather articles to be continuously dyed. It only needs one operator. It is economical, as there is no wastage of dye. The dye picked up by the application roller is either applied to the leather articles, or is carried on the application roller back to the dye bath or container. Consequently, unlike techniques such as spraying there is no air or other pollution.

The technique enables just one side of a leather article to be dyed. Thus, the other side could be dyed a different colour. It is also possible that, by suitable design of rollers and synchronization of the apparatus, one could dye leather in various patterns.

The apparatus can be simple and robust, which should give it a long life with low maintenance costs.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION

Figure 1:
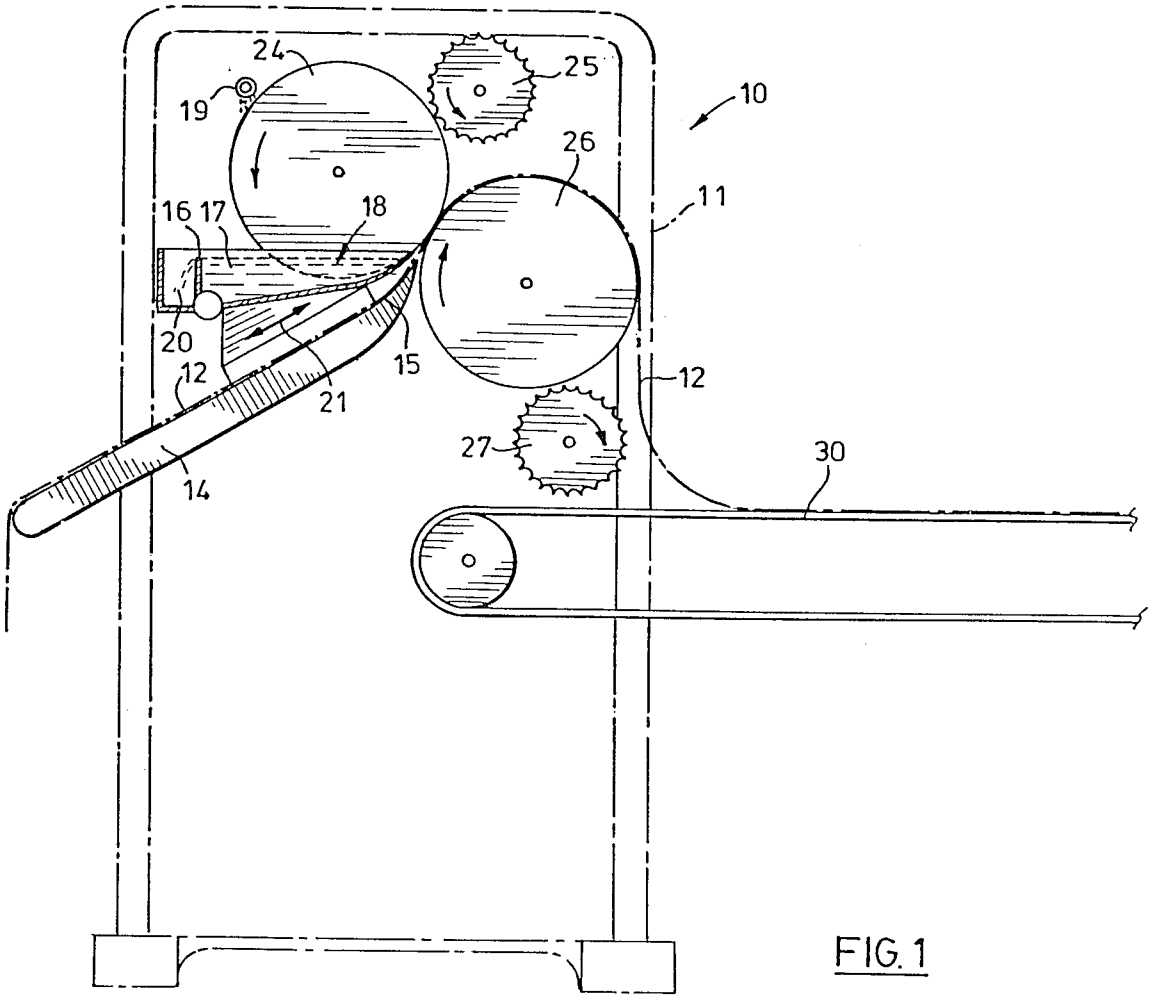
FIG. 1 shows a side view of an apparatus according to a first embodiment of the present invention

With reference to FIG. 1, there is shown an apparatus in accordance with one embodiment of the present invention, generally denoted by the reference 10. In known manner, the apparatus 10 includes a frame 11, supporting the various components of the apparatus. The apparatus includes various rotatably mounted components, and drive motors etc. (not shown) for rotating them. For clarity and simplicity, as these can be conventional components, they are not shown in the drawings. The drawings show the essential components of the apparatus.

Further, the invention is described in relation to an apparatus for dyeing individual or discrete pieces of leather. However, it is to be appreciated that the apparatus could be applicable to other sheet materials. Thus, the apparatus 10 includes a path 12 for leather.

An input table 14 is provided, for feeding leather articles into the apparatus. As shown, the input table 14 slopes upwardly in the direction of the leather path 12. In this first embodiment, the input table 14 can be a simple, fixed table. The right-hand end of the table 14 as viewed in FIG. 1, and as shown in greater detail in FIG. 3, includes an upwardly curved lip 15, to guide leather articles upwards.

A container 16 is provided for holding dye 17. The container 16 is open, to form an open dye bath 18. A dye supply conduit is indicated schematically at 19, and comprises an elongate tube that is perforated to provide a uniform spray on an application roller 24 described below. For maintaining the desired level of dye in the dye bath 18, an overflow channel 20 is provided. Further, the container 16 is movably mounted, as indicated at 21; it can be moved generally parallel to the table 14. In use a slight excess of dye is supplied through the conduit. The excess flows out through overflow 20 to be recirculated, and this sets the level. The level relative to the application roller 24 is set by moving the container 16. The container 16 is also moved down to clean the roller 24.

The application roller 24 is rotatably mounted about a horizontal axis, and is immersed in the dye bath 18. As indicated by the arrow, the application roller 24 is mounted for counterclockwise movement as viewed in FIG. 1. Details of the application roller 24 are given below.

A backup roller 26 is also mounted for rotation about a horizontal axis. The backup roller 26 is intended to press leather articles uniformly against the application roller 24, and for this purpose is covered with a layer of a resilient material, for example rubber. As shown, the backup roller 26 rotates clockwise. It is mounted so that its surface is close to, but spaced from the application roller 24.

As is known, when handling discrete sheet articles, there is always the possibility that an article may cling to a roller. To allow for this effect, direction rollers 25, 27 are provided for the application and backup rollers 24, 26. The direction rollers 25, 27 are mounted close to, but spaced slightly from their respective rollers 24, 26. The direction rollers 25,27 have helical grooves, which have the section shown in the drawings. This creates helical ribs to catch leather articles. Further, the direction rollers 25, 27, as indicated by arrows, are rotated so that their surface portions close to the application and backup rollers 24, 26 are moving in opposite directions. Thus, the direction roller 25 is rotated counterclockwise, whilst the direction roller 27 is rotated clockwise. Then, if any piece of leather clings to either of the rollers 24, 26, as soon as it is carried around to the appropriate direction roller 25, 27, that direction roller 25 or 27 will peel the leather article from the roller 24 or 26 and cause it to return to the leather path 12.

A conveyor 30 is provided for carrying leather articles from the apparatus 10 to a dryer.

Figure 4:
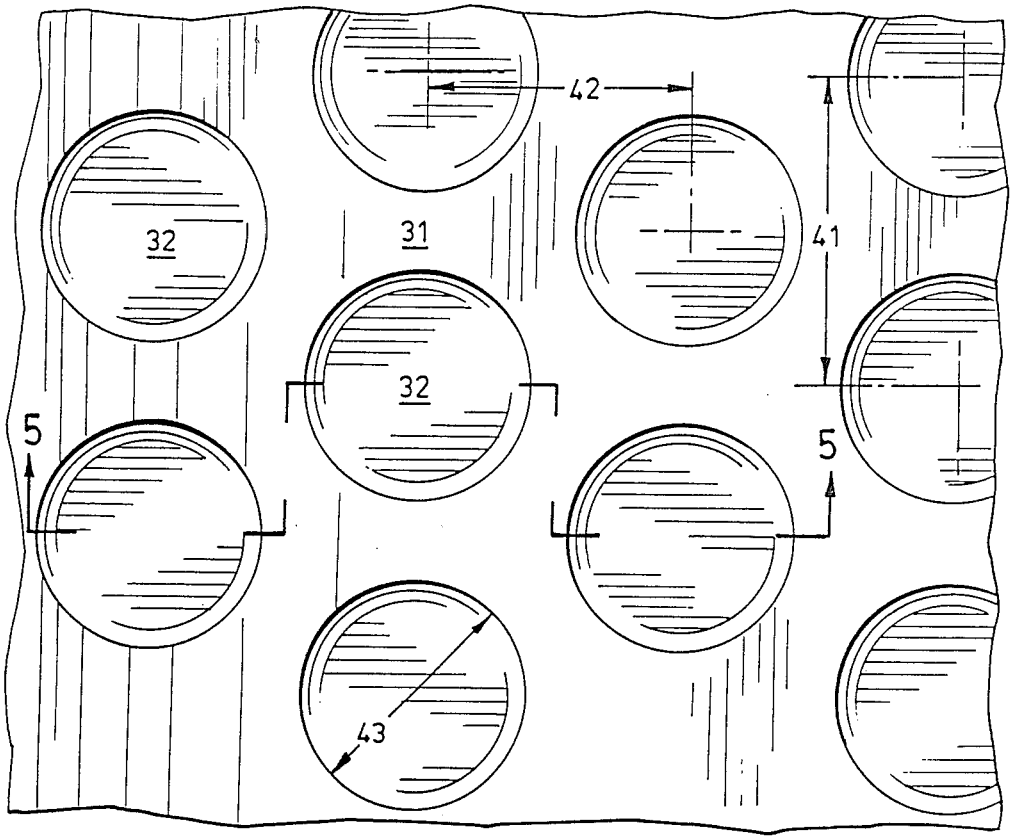
FIG. 4 shows a plan view of recesses on part of the surface of an application roller of the apparatus.
Figure 5:
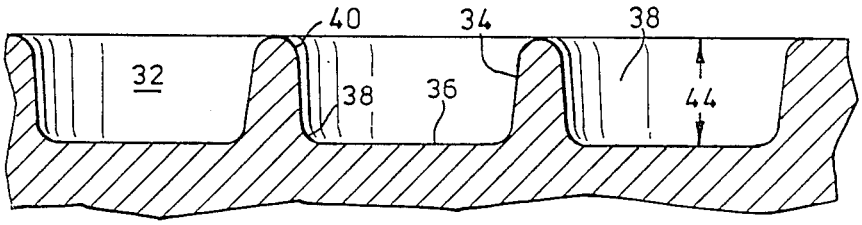
FIG. 5 shows a section along the line 5—5 of FIG. 4.
Figure 6:
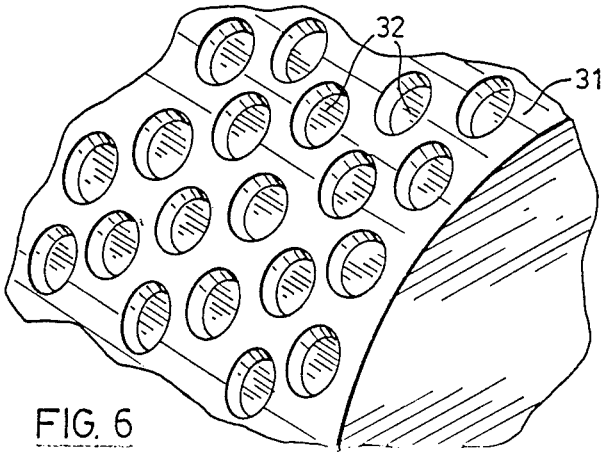
FIG. 6 shows a perspective view of one end of the roller of the apparatus.

Reference will now be made to FIGS. 4, 5 and 6 which show details of the surface of the application roller 24. Application roller 24 is a cylindrical metal roller whose surface is denoted at 31. A small portion of the surface 31 of the roller is shown in FIG. 4. It is provided with a number of circular recesses 32, which are arranged in a triangular pattern. Each recess 32 is generally circular. The recess 32 has a side wall 34 that tapers slightly, i.e. the side wall 34 is frustro-conical. An end wall 36 is joined to the side wall 34 by rounded corners 38. The top of the side wall 34 has rounded corners 40.

The following exemplary dimensions are given for the principal components of the apparatus 10. Each recess 32 has a diameter 43 at the top of 1.5 millimeters, and a depth 44 of 0.5 millimeters. The recesses 32 are spaced in the direction 41, representing the centre to centre spacing, by 2 millimeters, and in the direction 42 by approximately 1.75 millimetres. This gives 27.85 recesses 32 for each square centimetre of the surface 31. This proves a recess volume of 2.4 cc per $dm^2$, which is equivalent to 22.29 cc/sq.ft. Assuming a density of 1 gm/cc for the dye, then from fluid in the recesses 32, one could apply dye at a maximum of 22.29 grams/sq. ft. By way of example in an alternative embodiment, the recesses has a diameter of 3 mm at a centre to centre spacing of 3.5 mm. This gives a recess volume of 3.3 cc per $dm^2$; hence, considering just dye carried in the recess, dye could be supplied at a rate in excess of 30 grams/sq. ft. In practice, the amount of dye that can be absorbed is controlled by other factors, such as the nature of the leather, speed through the apparatus, etc. However, it will be realized that the volume of the recesses per unit surface area of the application roller can be varied to give the desired application rate for the dye.

With regard to the other components, the input table 14 can be inclined at 30° to the horizontal and its lip can have a radius of 152 mm centred to the left of the axis of the application roller 24. Both the application and back up rollers 24, 26 can have a diameter of 200 mm. The direction rollers 25, 27 have diameters of 100 mm and are spaced from the respective application and back up rollers by 0.75 mm. Correspondingly, a gap 52 is 0.75 mm but this can be adjusted for different thickness. A line between the axes of the rollers 24, 26 is inclined at 30° to the horizontal. Similarly, the axis of the direction roller 25 is on a line through the axis of the roller 24 that is at 30° to the horizontal, whilst the axis of the direction roller 27 is on line through the axis of the back up roller 26 that is at an angle of 15° to the vertical.

A description of the mode of operation of the apparatus 10 will now be given, primarily with reference to FIG. 3.

The application and backup rollers 24, 26 are rotated by a common variable speed drive. Here, these rollers 24, 26 have the same diameter, and consequently they are rotated at the same speed, to give the same surface speed. The conveyor 30 is operated at a speed sufficient to carry away leather articles as they are delivered from the backup roller 26.

Leather articles are delivered to the apparatus by simply placing them, free of wrinkles etc. on the input table 12. Such a leather article is indicated at 50 in FIG. 3. The leather article 50 is then fed along the input table 14, so that the lip 15 guides it upwards. The narrowest point or gap between the two rollers 24, 26 is denoted by the reference 52. This gap 52 is adjustable, to accommodate leathers of different thicknesses. The leather article 50 is guided by the lip 15 into this gap 52. The rotating rollers 24, 26 then catch the leather article 50 and pull it through the gap 52.

As the application roller 24 rotates counterclockwise, its surface 31 is both sprayed with dye by the supply pipe 19 and immersed in the dye bath 18. Consequently, the recesses 32 are filled with the dye 18. Immersion alone, particularly shallow immersion, might not result in complete filling of the recesses due to air pockets being formed in the recesses 32. Due to the arrangement of the rollers 24, 26, after the recesses 32 leave the bath 20, they quickly come into contact with the top surface 51 of the leather article 50. Consequently, the dye 18 within the recesses 32 has little opportunity to run out of the recesses 32 back down into the dye bath 20. It has further been discovered that, under appropriate operating conditions, the application roller 24 appears to carry a thin film on its surface 31 to the leather surface 51. When the recesses 32 contact the top surface 51, this creates a contact zone in the gap 52 between the application roller 24 and the top surface 51 of the article 50. This causes the dye to penetrate the top surface 51.

Figure 3:
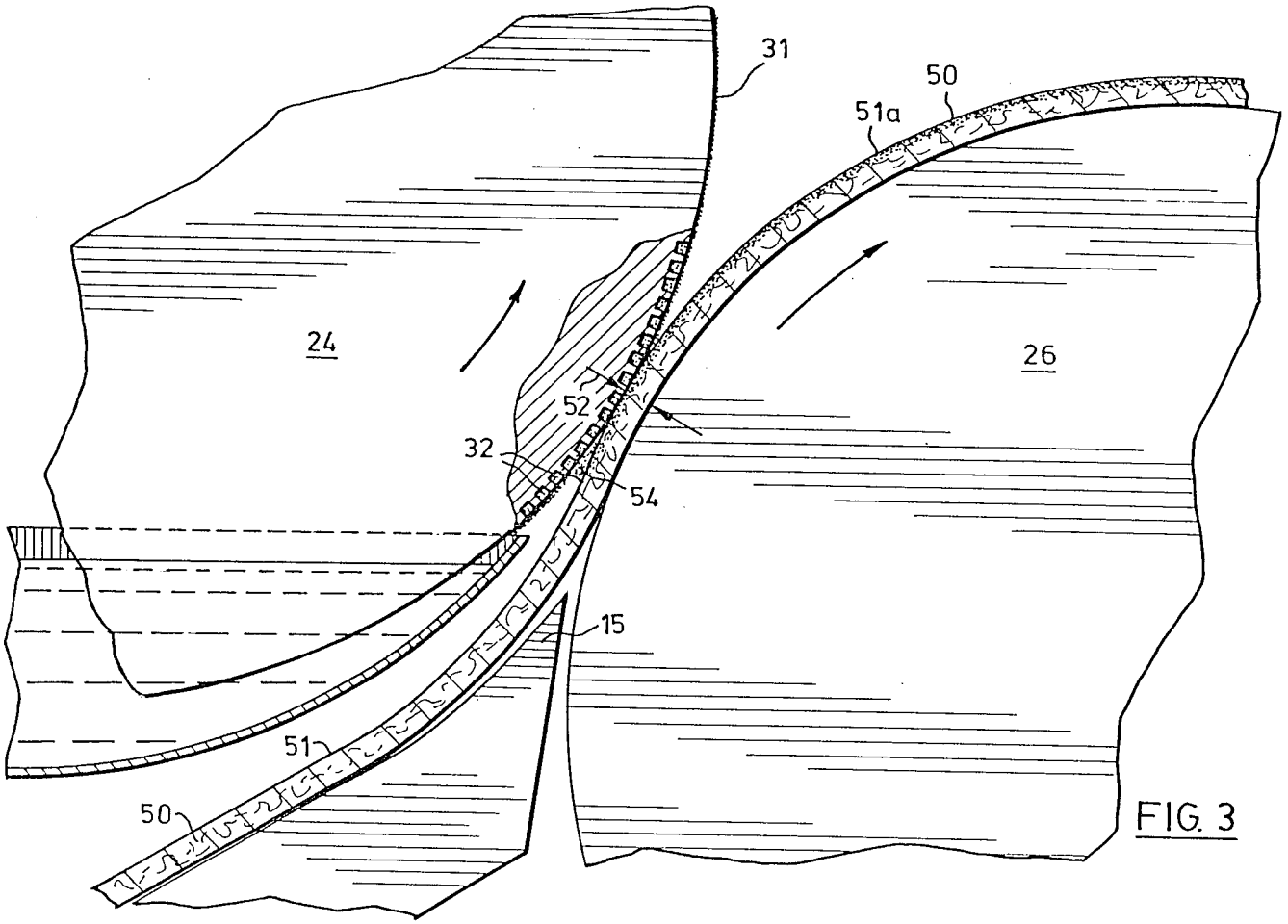
FIG. 3 shows a vertical section through part of the apparatus of FIG. 1, on a larger scale.

Also, as indicated in FIG. 3, it has been found that, immediately after a leather article 50 enters the gap 52, a wedge-shaped quantity of dye is formed at 54. This wedge or inventory 54 is formed between the roller surface 31 and the top leather surface 51, immediately before they contact one another. It is formed by dye 18 displaced from the recesses 32 and any dye carried as a film on the roller surface 31. This assists in an even dyeing of the top surface 51. The wedge or inventory 54 is uniformly and continuously spread onto the top surface 51 by the roller 24, as the leather article 50 passes between the rollers. It is to be realized that, as in gravure printing, if one was relying solely on the dye in each recess 32 to impregnate the corresponding spot on the top surface 51, then one would obtain a pattern of dots on the top surface 51 corresponding to the pattern of the recesses 32. In contrast, with the technique of the present invention, the roller 24 uniformly spreads the wedge or inventory 54 into the top surface 51, to give even impregnation.

The dimensions of the recesses, etc. and operating characteristics are adjusted to get this even application.

The dye 17 is absorbed into the leather surface by a capillary action. For this purpose the dye should have a low viscosity, e.g. in the range of 10–10.5 seconds for No. 4 Ford Beaker. This then given good penetration of the dye. The resultant dyed top surface 51 is indicated at 51*a*. The leather article 50 then continues on around the backup roller 26 to the conveyor 30, which carries the article 50 to the next process step.

Figure 2:
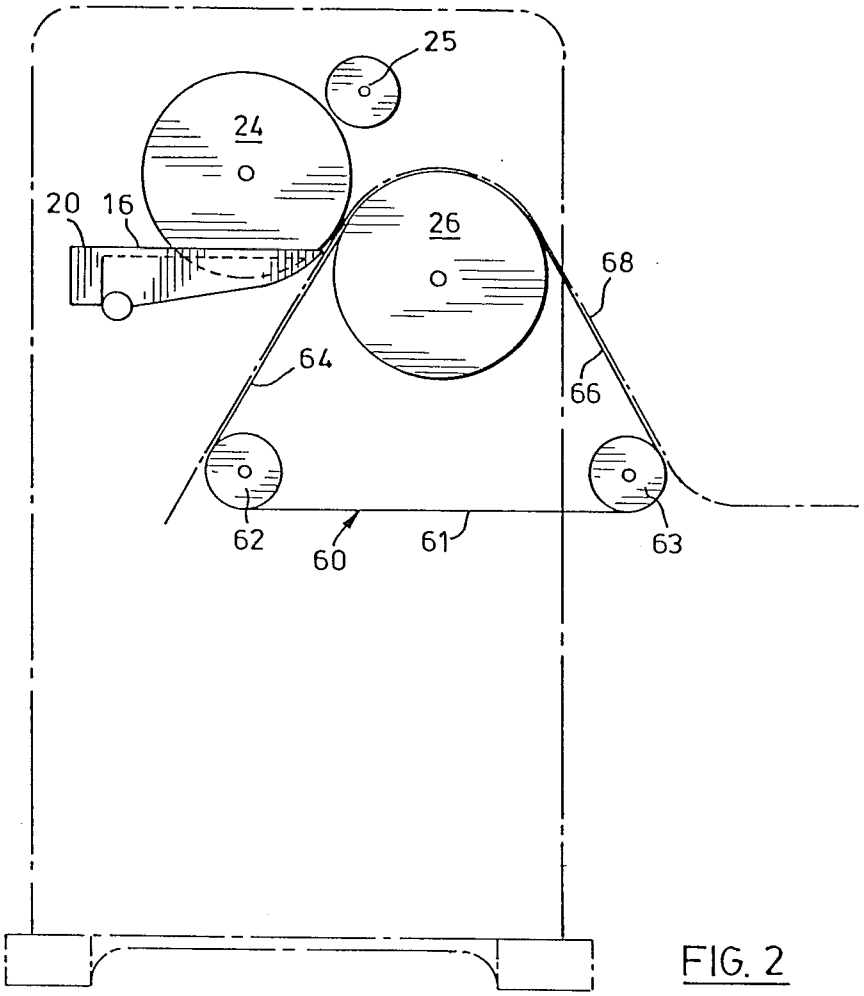
FIG. 2 shows a side view of an apparatus according to a second embodiment of the present invention.

Reference will now be made to FIG. 2, which shows a variant of the apparatus. Here, many components are similar to those in FIGS. 1 and 3, and for simplicity these common components are given the same reference numeral. Further, the description of these common components is not repeated.

Here, the input table 14 is dispensed with, and a conveyor 60 is provided. The conveyor 60 includes a conveyor belt 61 which encircles the backup roller 26 and also two additional rollers 62, 63. Thus, the conveyor belt 61 forms an input span 64 and an output span 66. A modified leather path 68 follows these spans 64, 66. Leather article 50 are carried up the input span 64, and as before dyed on their top surface by the application roller 24. The dyed leather articles then exit along the output span 66. It is to be noted that the leather articles 50 are not pressed directly by the backup roller 26 against the roller 24, but are instead pressed by the portion of the belt 61 around the backup roller 26.

Figure 7:
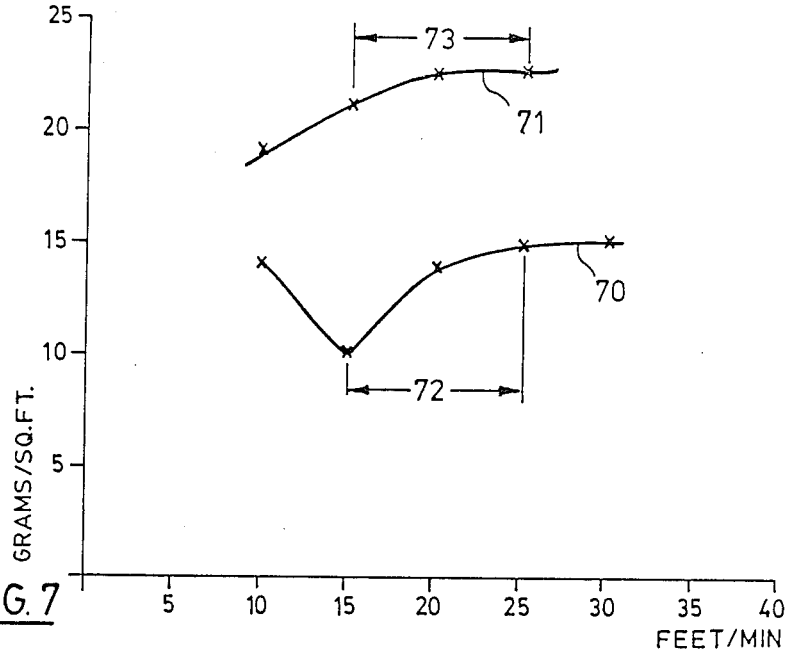
FIGS. 7, 8 and 9 show graphs of characteristics of the apparatus.
Figure 8:
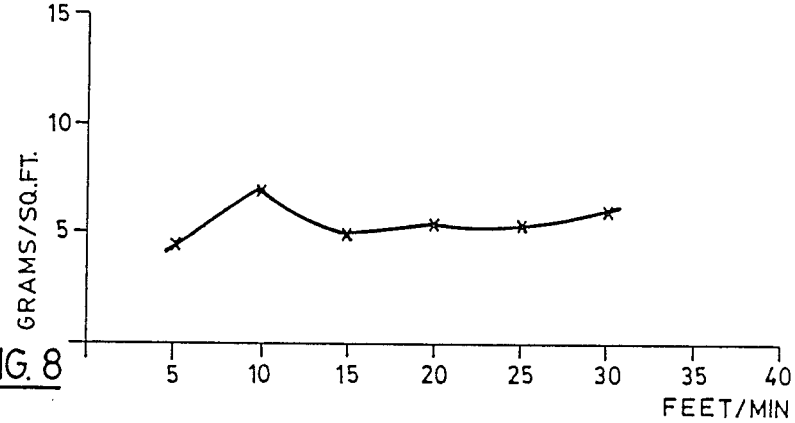
Figure 9:
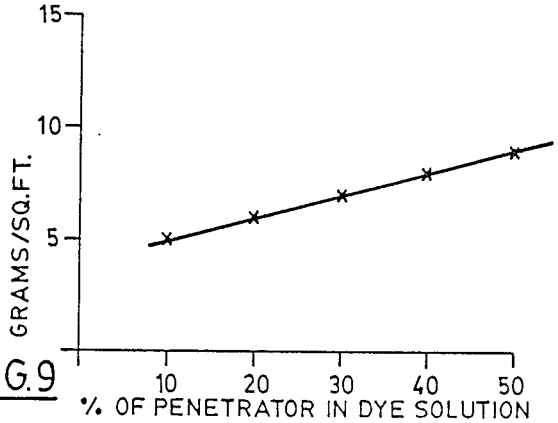

Reference will now be made to FIGS. 7, 8 and 9, which show the effect of varying various parameters in the operation of the apparatus 10.

In FIG. 7, the horizontal axis shows the variation of the speed of the leather articles 50 and hence the surface speed of the rollers 24, 26, the speed being given in feet per minute. The vertical axis indicates the variation in absorption of the dye solution in grams per square foot. A first curve 70 indicates the variation for full grain leather (bellies), whilst a second curve 71 indicates the variation for suede splits. The leather was supplied by White Tanning Co. The dye solution used contained 20 parts penetrator and 80 parts water.

As shown by the curve 70 at a speed of 10 feet per minute, one obtained absorption of approximately 14 grams/square foot. This absorption reduced to 10 grams/square foot for a speed of 15 feet/minute. The reason for this decrease is not fully understood. It is believed that this low absorption at 15 feet/minute is an anomaly, although a corresponding, reverse anomaly occurs in FIG. 8. If one ignores this figure at 15 feet/minute, then generally one can see a trend of increasing absorption with increasing speed. This is believed to be due to the fact that as the speed of the application roller 24 is increased, then more fluid is retained by it and applied to the leather. It is worth noting that this is contrary to many other processes, where increasing the speed of the leather through the apparatus reduces the dye absorption.

As shown in FIG. 7, at a speed of 20 feet/minute there is an absorption of 14 grams/square foot, which increases to 15 grams/square foot at 25 feet/minute. Finally, at the speed of 30 feet/minute there is an absorption of approximately 15.25 grams/square foot. As indicated at 72, it is believed that the optimum speed range is between 15–25 feet/minute.

Consistent with the theory that the absorption is related to the speed of the roller 24, the curve 71 shows a progressive increase in the absorption with increasing speed. Thus, at 10 feet/minute, there is an absorption of 19 grams/square foot. This increases through 21, 21.5 and a figure in excess of 21.5 grams/square foot, for the speeds 15, 20 and 25 feet/minute. Again, for the suede splits represented by this curve 71, it is believed that the optimum speed is in the range 15–25 feet/minute, as indicated at 73. It is to be noted that this absorption rate of in excess of 20 gms/sq.ft. with a low viscosity dye is, to applicant's knowledge, not attainable with conventional roller coating equipment.

With reference to FIG. 8, there is shown a graph similar to FIG. 7, with the horizontal axis again indicating the roller surface speed and the vertical axis indicating the absorption. The same dye solution was used, having a composition of 80 parts water and 20 parts penetrator. The leather used was leather marketed under the name "Neotan" by Beardmore Co. This leather has a low absorbency due to earlier processing; comparable results are obtainable with high absorbency leather. As can be seen, the minimum absorption of approximately 4.5 grams/square foot was obtained for a velocity of 10 feet/minute. Again, at 15 feet/minute, there is a somewhat anomalous absorption of 7 grams/square foot. Ignoring this result, the maximum absorption of 6 grams/square foot is obtained at a speed of 35 feet/minute. Otherwise, there is a fairly progressive increase in absorption between those figures for the intermediate speeds. Also, for this type of leather, the amount of absorption, whilst increasing with speed, does not vary significantly. By more than tripling the speed from 10 to 35 feet/minute, one obtains an increase in absorption of only 33%. As can be seen from the speeds, a high through put can be achieved, independently of the total quantity to be dyed.

FIG. 9 shows a graph of the absorption on the vertical axis, again in grams/square foot, against the percentage of penetrator in the dye solution. The same leather, "Neotan", was used as for the FIG. 8 example. The speed was fixed at a constant 25 feet/minute.

As can be seen, by varying the percentage of penetrator in the dye solution one obtains a progressive increase in the amount of absorption. This absorption increases linearly from 5 grams/square foot at 10% penetrator concentration to 9 grams/square foot at 50% penetrator concentration.

It is also to be appreciated that the apparatus of the present invention utilizes dye efficiently. No dye is wasted or contaminates conveyors as in spraying. Also, dye not transferred from the application roller to a leather article is retained in the recesses and returned to the dye bath. Further, the technique ensures that only one side of the leather is dyed.

It is to be noted that whilst preferred embodiments of the invention have been described, many variations are possible. Thus, the size and disposition of the recesses can be varied greatly. For example, instead of providing individual discrete recesses, the cylindrical surface of the application roller could be provided with horizontal or other grooves, which should be arranged bearing in mind that the dye has a low viscosity. It has been found that, for helical grooves, the dye tends to run to the lowermost end of each groove. Also whilst the application roller is shown above the back up roller this need not necessarily be the case. Thus, the application roller could be below the back up roller and could apply the dye to the underside of the leather.

Whilst a plain backup roller is shown, for some purposes it may be desirable to dye both sides of the leather. In this case, the backup roller would similarly be provided with recesses, and immersed/sprayed with dye. Then both sides of the leather will be uniformly dyed as it passes through the apparatus.

We claim:

1. An apparatus for dyeing sheet articles, the apparatus comprising: input means for supplying articles to the apparatus; an application roller means mounted for rotation about a generally horizontal axis and including recess means in the surface therof; dye supply means for supplying dye to the surface of the application roller including a container for dye below the application roller means; a backup means mounted adjacent the application roller means, and below the axis thereof, to define an inclined gap below the axis of the application roller means and between the application roller means and the backup means, the gap being arranged to receive, in use, sheet articles from the input means, whereby the recess means of the application roller means carries dye onto an upper side of sheet articles passing through the gap, the apparatus not including a doctor blade means for removing excess dye from the application roller means prior to contact with sheet articles.

2. An apparatus as claimed in claim 1, wherein the backup means comprises a backup roller means rotatably mounted about a horizontal axis below the axis of the application roller means and beside the container.

3. An apparatus as claimed in claim 2, wherein the application and backup roller means have the same diameter and are driven by a common drive means.

4. An apparatus as claimed in claim 2, wherein the backup roller has a resilient cover, to accommodate sheet articles of varying thickness.

5. An apparatus as claimed in claim 2, 3 or 4 wherein part of the application roller is below the top of the container so as, in use, to be immersed in the dye.

6. An apparatus as claimed in claim 2, wherein each of the application and backup rollers is provided with a respective direction roller, which is rotated to prevent a sheet article being carried around the respective application or backup roller, and wherein the apparatus includes an output conveyor for conveying dyed articles from the backup roller.

7. An apparatus as claimed in claim 6, wherein the direction rollers include helical grooves.

8. An apparatus as claimed in claim 2, wherein the input means comprises a conveyor belt, which extends around the backup roller, and which includes an input span inclined upwardly towards the backup roller and an output span extending from the backup roller.

9. An apparatus as claimed in claim 8, wherein the application roller is provided with a direction roller mounted adjacent the application roller and rotated to prevent articles being carried around the application roller.

10. An apparatus as claimed in claim 1, wherein the recess means comprises a plurality of discrete recesses.

11. An apparatus as claimed in claim 10, wherein the recesses are circular.

12. An apparatus as claimed in claim 11, wherein the recesses on the application roller are disposed in a triangular pattern.

13. An apparatus as claimed in claim 12, wherein each of said recesses has a tapered, frustro-conical side wall and a flat bottom wall.

14. An apparatus as claimed in claim 10, 12 or 13, wherein the volume of the recesses per square centimetre of the surface of the application roller is greater than 20 cubic millimeters.

15. An apparatus as claimed in claim 1, 2 or 10, wherein the dye supply means includes a conduit extending generally parallel and adjacent the application roller means and being perforated so as to spray dye onto the application roller means.

16. An apparatus as claim in claim 1, wherein the input means comprises an input table, which includes a main portion inclined upwardly towards the gap between the application roller means and the backup means, and a lip inclined upwardly at a greater angle than said main portion and extending below the container from the main portion towards the gap formed between the application roller and backup means.

17. An apparatus for dyeing discrete sheet leather articles, the apparatus comprising: an input means for moving articles into the apparatus; a container for a dye; a cylindrical, application roller rotatably mounted about a horizontal axis above the container, the application roller including a plurality of recesses in a triangular pattern on the cylindrical surface thereof, each of which recesses is generally circular and includes a tapered, frustro-conical side wall and a flat bottom wall; perforate conduit means mounted adjacent the application roller for spraying the application roller with dye; a cylindrical backup roller rotatably mounted about a horizontal axis below the horizontal axis of the application roller and including a resilient cover of uniform thickness, the backup roller being mounted adjacent the application roller to form a gap for receiving sheet articles, the application and backup rollers being arranged to receive in use sheet leather articles in said gap therebetween from the input means, with the recesses of the application roller carrying dye from the container onto one side of the sheet leather articles.

18. An apparatus for dyeing discrete sheet leather articles, the apparatus comprising: input means for supplying articles to the apparatus; a container for dye; an application roller means rotatably mounted about a generally horizontal axis above the container, and including recess means in the surface thereof; dye supply means for supplying dye to the surface of the aplication roller; a backup means mounted adjacent the application roller and below the axis thereof, the application roller means and the backup means being arranged to receive, in use, sheet articles therebetween from the input means, with the recess means of the application roller means carrying dye onto one side of the sheet articles.

19. A method of dyeing a sheet article, the method comprising: supplying dye to an application roller means having a generally horizontal axis and including recess means in its surface to fill the recess means with dye which supply includes immersion of the application roller means in a container of dye, providing a backup means adjacent and below the application roller means to define an inclined gap for sheet articles beneath the axis of the application roller means between the application roller mans and the back up means, rotating the application roller means about the generally a horizontal axis so that dye picked up by the application roller is carried towards the backup means, and supplying sheet articles between the application roller means and the backup means so that dye carried by the recess means of the application roller meansis applied to an upper side of the sheet article, without removing excess dye from the application roller by a doctor blade means prior to contact with sheet articles.

20. A method as claimed in claim 19, wherein the backup means comprises a backup roller rotated about a horizontal axis.

21. A method as claimed in claim 20, wherein the recesses of the application roller have a volume of at least 20 cubic millimetres per square centimetre of the surface of the application roller.

22. A method as claimed in claim 19, wherein dye is supplied continuously to application roller in excess of the capacity of the recess means, dye being collected in the container and discharged.

23. A method as claimed in claim 22, wherein the dye has a viscosity equal to or slightly greater than the viscosity of water.

24. A method as claimed in claim 23, wherein the dye has a viscosity in the range 10–10.5 seconds as measured on a No. 4 Ford Beaker.

25. A method as claimed in claim 23 when applied to a plurality of discrete sheet articles, which are dyed sequentially.

26. A method as claimed in claim 23, when applied to a plurality of discrete leather articles, which are dyed sequentially.

* * * * *